US008596751B2

(12) United States Patent
Kuroki

(10) Patent No.: US 8,596,751 B2
(45) Date of Patent: Dec. 3, 2013

(54) HEAD CAP AND INK-JET PRINTER

(75) Inventor: Kenji Kuroki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1045 days.

(21) Appl. No.: 12/624,393

(22) Filed: Nov. 23, 2009

(65) Prior Publication Data

US 2010/0128083 A1 May 27, 2010

(30) Foreign Application Priority Data

Nov. 27, 2008 (JP) ..... 2008-302754

(51) Int. Cl.
*B41J 2/165* (2006.01)

(52) U.S. Cl.
USPC ..... 347/29

(58) Field of Classification Search
USPC ..... 347/29, 30
See application file for complete search history.

(56) References Cited

U.S. PATENT DOCUMENTS 6,866,361 B2 3/2005 Kuki et al.
6,918,650 B2 7/2005 Umeda et al.

FOREIGN PATENT DOCUMENTS

JP 2004-058417 A 2/2004
JP 2004-142450 A 5/2004
JP 2004-291326 A 10/2004

*Primary Examiner* — Matthew Luu
*Assistant Examiner* — Justin Seo
(74) *Attorney, Agent, or Firm* — Baker Botts L.L.P.

(57) ABSTRACT

A head cap may comprise a cap body comprising a circular projection which is configured to surround a liquid droplet ejection area formed on an ejection surface of a liquid droplet ejection head by contacting with the ejection surface, and a bottom plate portion which is configured to define a depressed portion in cooperation with the circular projection and to which the circular projection is connected. The head cap may also comprise a holder which is configured to hold the bottom plate portion. The head cap may further comprise a fixing member which is configured to fix the cap body to the holder by being fitted to the holder via the bottom plate portion and disposed on a bottom surface of the depressed portion. The fixing member and the holder may clamp the bottom plate portion in the direction intersecting the direction of projection of the circular oroiection.

16 Claims, 11 Drawing Sheets

HEAD CAP AND INK-JET PRINTER

CROSS REFERENCE TO RELATED APPLICATION

This application claims priority to Japanese Patent Application No. 2008-302754, filed Nov. 27, 2008, the entire subject matter and disclosure of which is incorporated herein by reference.

BACKGROUND OF THE DISCLOSURE

1. Field of the Disclosure

The features herein relate to a head cap configured to cover an ejection surface of a liquid droplet ejection head for ejecting a liquid droplet, and an ink-jet printer comprising the head cap.

2. Description of the Related Art

A known ink-jet printer includes an ink-jet head and a maintenance unit configured to perform the maintenance of the ink-jet head. The maintenance unit includes a cap formed of an elastic member such as rubber for covering a nozzle surface of the ink-jet head. By the cap covering the nozzle surface, ink in nozzles is prevented from being dried.

SUMMARY OF THE DISCLOSURE

In the ink-jet printer described above, a circular projection for defining a depressed portion is disposed on the cap. The maintenance unit brings the circular projection of the cap into contact with the nozzle surface such that the nozzle surface of the ink-jet head is covered by the depressed portion of the cap. When the circular projection of the cap is in contact with the nozzle surface for a long time, the circular projection may be adhered to the nozzle surface with ink remaining on the nozzle surface. When the cap is forcedly separated from the nozzle surface in this state, the cap may drop out from a holder. In order to prevent this event, it is considered to fit a projection formed on a side surface of the cap to the holder. However, since the projection is projected to the outside of the cap, the cap is upsized. A need has arisen for a head cap which is downsized while fixing the cap reliably, and an ink-jet printer comprising the head cap. According to one embodiment herein, a head cap may comprise a cap body comprising a circular projection which is configured to surround a liquid droplet ejection area formed on an ejection surface of a liquid droplet ejection head by contacting with the ejection surface, and a bottom plate portion which is configured to define a depressed portion in cooperation with the circular projection and to which the circular projection is connected. The head cap may also comprise a holder which is configured to hold the bottom plate portion. The head cap may further comprise a fixing member which is configured to fix the cap body to the holder by being fitted to the holder via the bottom plate portion and disposed on a bottom surface of the depressed portion. The fixing member and the holder may clamp the bottom plate portion in the direction intersecting the direction of projection of the circular projection.

Other objects, features, and advantages will be apparent to those skilled in the art from the following detailed description and accompanying drawings.

BRIEF DESCRIPTION OF THE DRAWINGS

Embodiments are described with reference to the accompanying drawings, which are given by way of example only, and are not intended to limit the present patent.

DETAILED DESCRIPTION OF EMBODIMENTS

Various embodiments, and their features and advantages, may be understood by referring to FIGS. 1-11, like numerals being used for corresponding parts in the various drawings.

Figure 1:
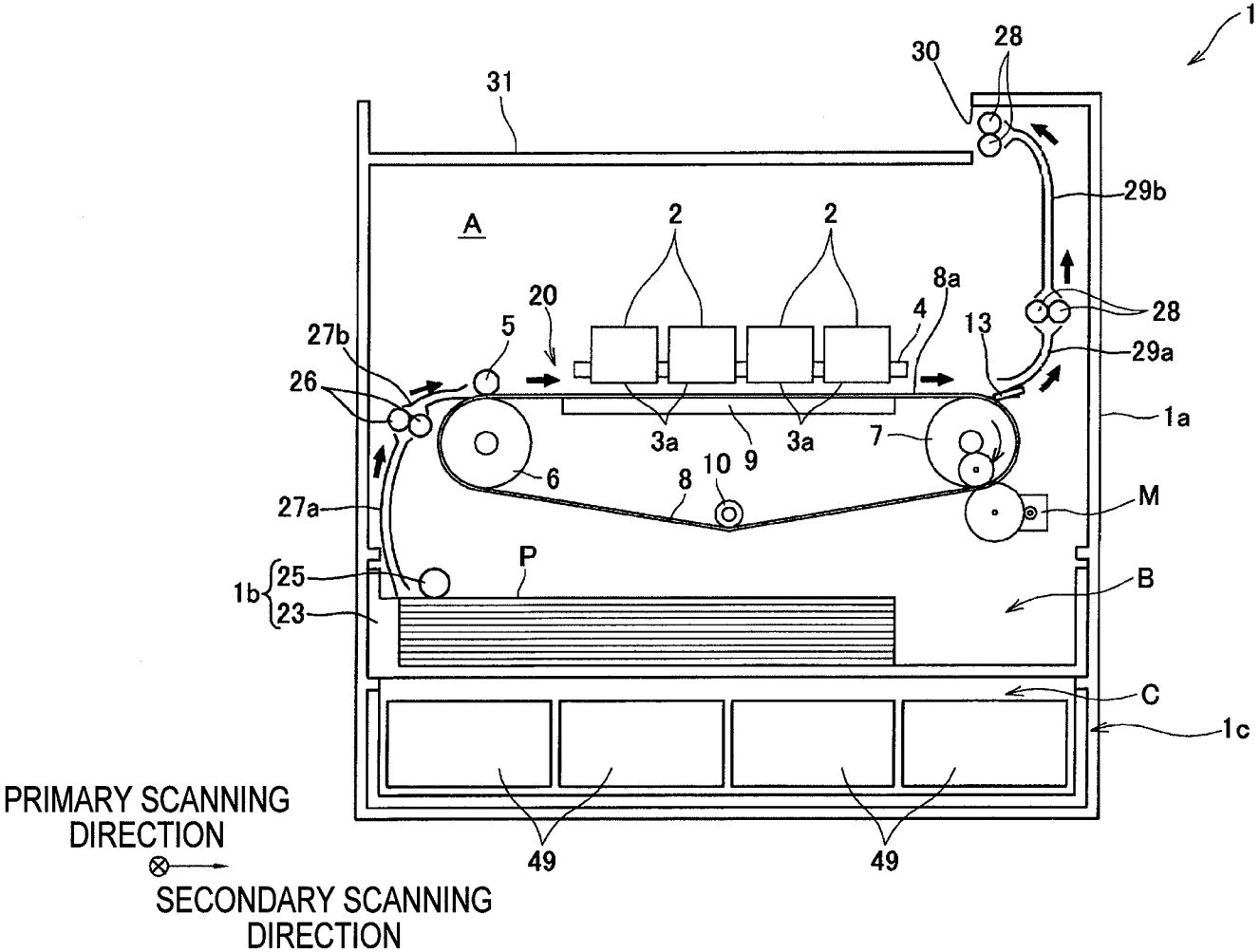
FIG. 1 is a schematic side cross-sectional view of an ink-jet printer according to an embodiment.
Figure 2:
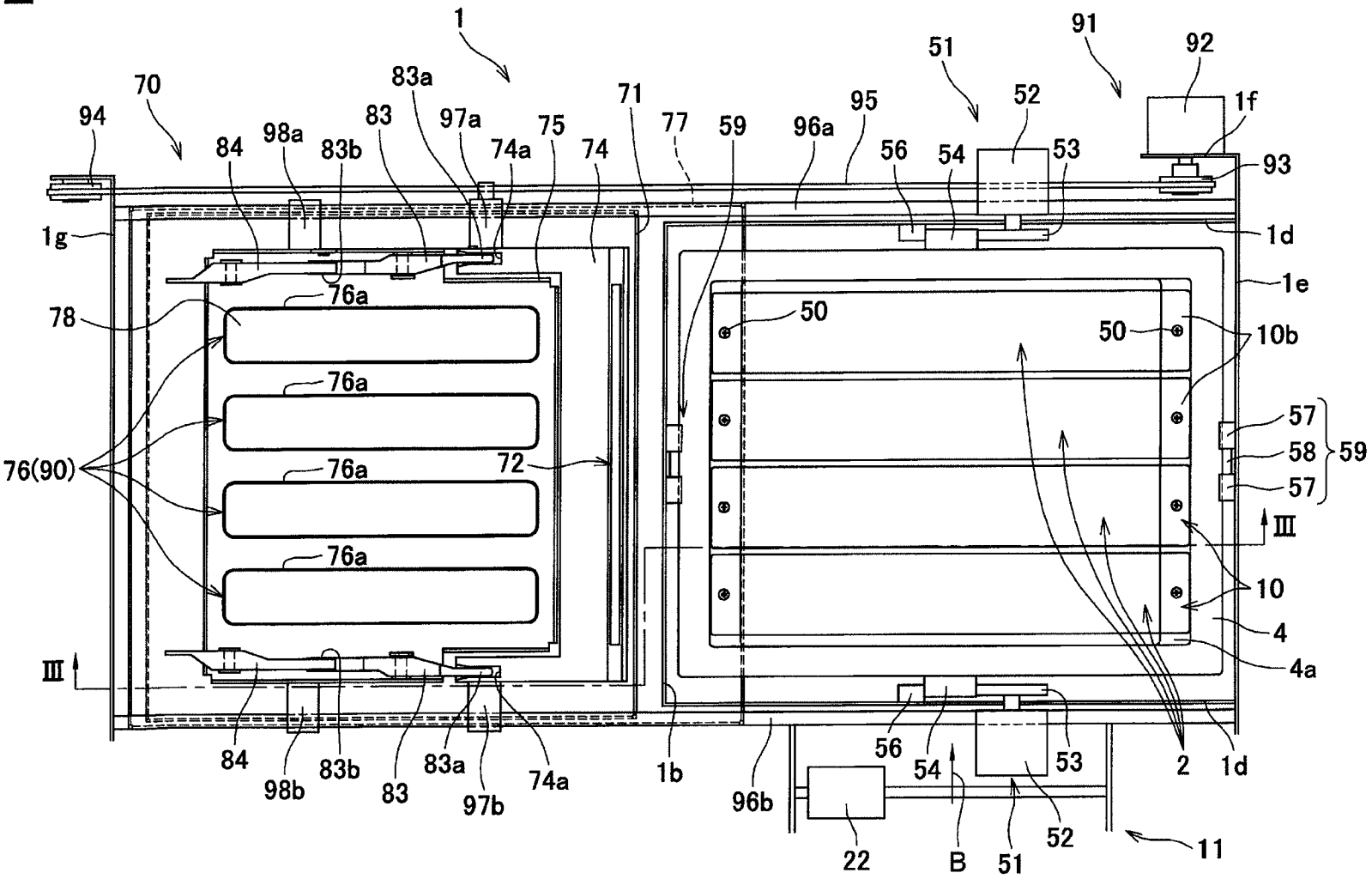
FIG. 2 is a schematic plan view of a principal portion of the ink-jet printer shown in FIG. 1.
Figure 3:
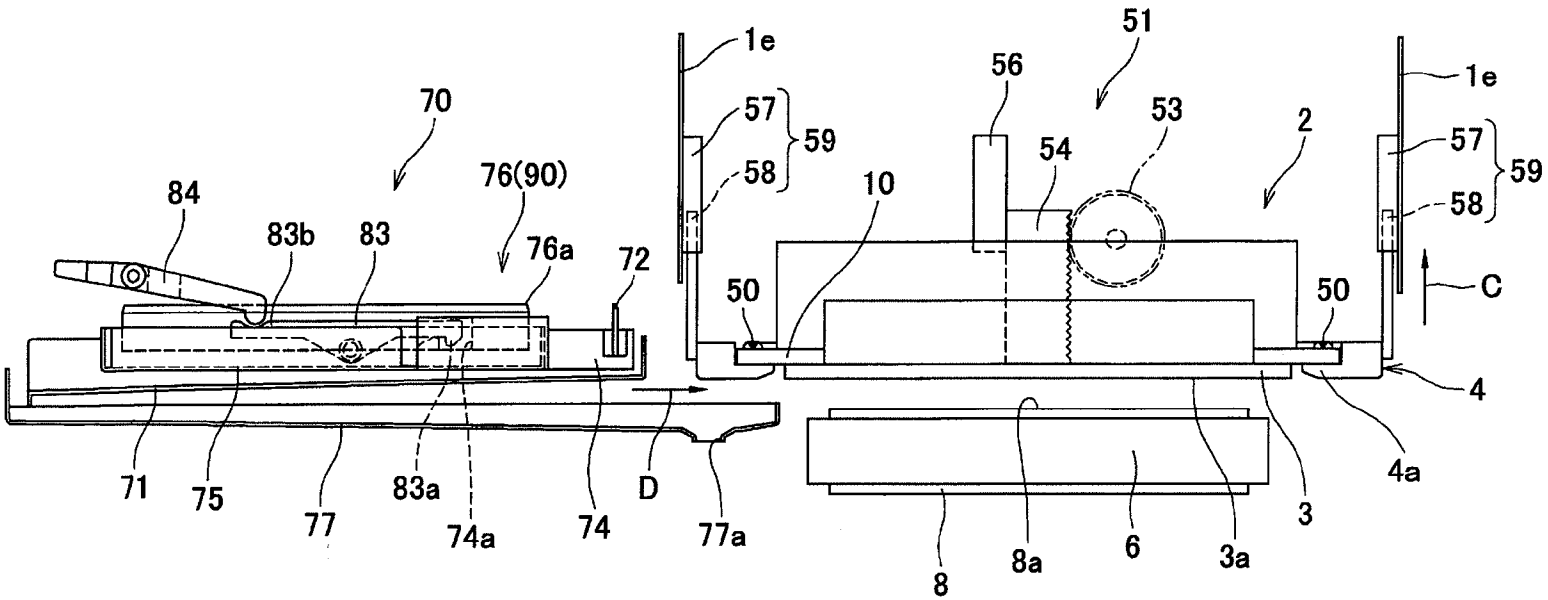
FIG. 3 is a cross-sectional view taken along the line in FIG. 2.

Referring to FIG. 1 to FIG. 3, an ink-jet printer 1 includes a housing 1*a* of a parallelepiped shape. A paper discharging portion 31 is positioned on an upper portion of the housing 1*a*. The interior of the housing 1*a* is divided into three spaces A, B, and C in sequence from the top. A plurality of, e.g., four, ink-jet heads 2 which eject inks in magenta, cyan, yellow, and black respectively, a transporting unit 20, and a maintenance unit 70 (inner side of the transporting unit 20 in terms of the paper plane of FIG. 1) are arranged in the space A. The spaces B and C are spaces in which a paper feeding unit 1*b* and an ink tank unit 1*c* which are demountably mounted on the housing 1*a* are arranged respectively. In this embodiment, the secondary scanning direction is a direction parallel to the transporting direction when transporting a paper P by the transporting unit 20, and the primary scanning direction is a direction orthogonal to the secondary scanning direction and is a direction along the horizontal plane.

In the interior of the ink-jet printer 1, a paper transporting path in which the paper P is transported is formed from the paper feeding unit 1*b* toward the paper discharging portion 31 (thick arrow in FIG. 1). The paper feeding unit 1*b* includes a paper feed tray 23 in which a plurality of pieces of paper P can be stored, and a paper feed roller 25 mounted on the paper feed tray 23. The paper feed roller 25 feeds the uppermost paper P from among the plurality of pieces of paper P stored in the paper feed tray 23 in stack. The paper P fed by the paper feed roller 25 is guided by guides 27*a* and 27*b*, and is fed to the transporting unit 20 while being pinched by a feed roller pair 26.

The transporting unit 20 includes a plurality of, e.g., two, belt rollers 6 and 7, an endless transporting belt 8 wound between the both rollers 6 and 7 so as to run therebetween, and a tension roller 10. The tension roller 10 is urged downward while being in contact with an inner peripheral surface of a lower loop of the transporting belt 8, and applies a tension to the transporting belt 8. The belt roller 7 is a driving roller which rotates clockwise in FIG. 1 by a drive force applied from a transporting motor M via two gears. The belt roller 6 is a driven roller which is rotated clockwise in FIG. 1 by the transporting belt 8 being traveled by the rotation of the belt roller 7.

A peripheral surface 8*a* of the transporting belt 8 is siliconized, thereby having an adhesive characteristic. A nip roller 5 is arranged at a position opposing the belt roller 6 on the paper transporting path with the intermediary of the transporting belt 8. The nip roller 5 presses the paper P fed from the paper feed unit 1*b* against the peripheral surface 8*a* of the transporting belt 8. The paper P pressed against the peripheral surface 8*a* is transported rightward in FIG. 1 while being held on the peripheral surface 8*a* by its adhesive characteristic.

A separating plate 13 is disposed at a position opposing the belt roller 7 on the paper transporting path with the intermediary of the transporting belt 8. The separating plate 13 separates the paper P held on the peripheral surface 8*a* of the transporting belt 8 from the peripheral surface 8*a*. The paper P separated by the separating plate 13 is guided by guides 29*a* and 29*b* and is transported while being pinched by a plurality of, e.g., two, pairs of feed roller pair 28, and is discharged from an opening 30 formed on the upper portion of the housing 1*a* to the paper discharging portion 31.

Figure 4:
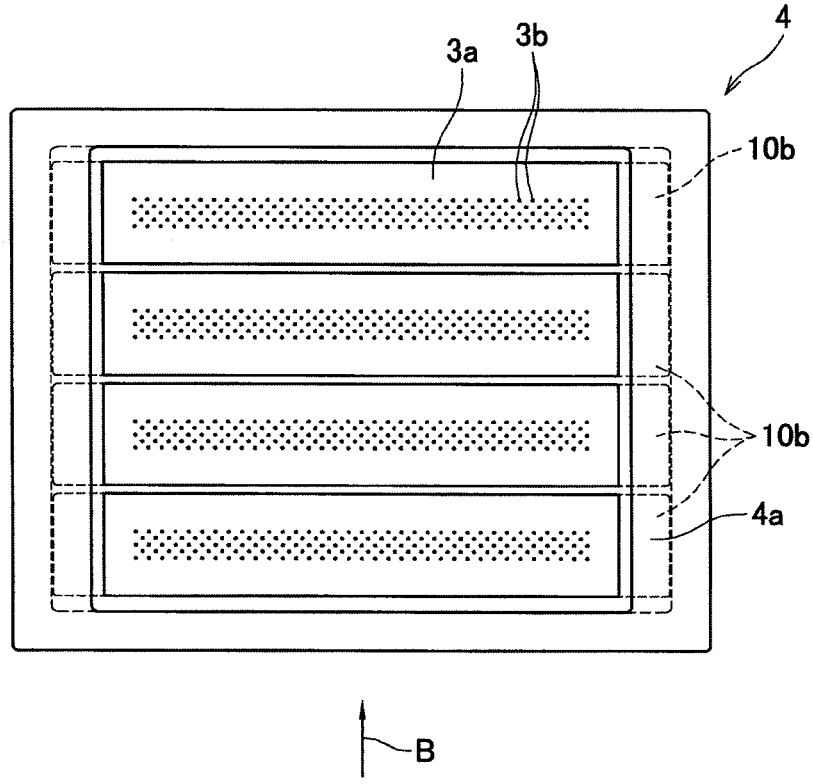
FIG. 4 is a bottom plan view of ink-jet heads shown in FIG. 2 when viewing the same from below.

Referring to FIG. 2 to FIG. 4, the plurality of, e.g., four, ink-jet heads 2 are fixed to a frame-shaped frame 4 in a state of extending along the primary scanning direction and being arranged adjacently to each other along a paper transporting direction B respectively. The frame 4 includes supporting portions 4*a* projecting to a position opposing a lower surface of both end portions in terms of the longitudinal direction of the ink-jet heads 2. Then, the supporting portions 4*a* and the both end portions of the ink-jet heads 2 are fixed by screws 50. Lower surfaces of the respective ink-jet heads 2 correspond to ejection surfaces 3*a* from which ink droplets are ejected. In other words, the ink-jet printer 1 is a line-type color ink-jet printer in which an ejection area extending in the primary scanning direction is formed.

Referring to FIG. 1, a platen 9 is positioned in a loop of the transporting belt 8 so as to oppose the plurality of, e.g., four, ink-jet heads 2. An upper surface of the platen 9 comes into contact with an inner peripheral surface of an upper loop of the transporting belt 8, and supports the same from the inner peripheral side of the transporting belt 8. Accordingly, the peripheral surface 8*a* of the upper loop of the transporting belt 8 and the lower surface of the ink-jet head 2, that is, the ejection surface 3*a* oppose in parallel to each other, and a small gap is formed between the peripheral surface 8*a* of the transporting belt 8 and the ejection surface 3*a*. The gap configures part of the paper transporting path. When the paper P transported while being held on the peripheral surface 8*a* of the transporting belt 8 passes immediately below the plurality of, e.g., four, ink-jet heads 2, inks in the respective colors are discharged toward an upper surface of the paper P in sequence from the respective ink-jet heads 2, such that a desired color image is formed on the paper P.

Referring to FIG. 2 and FIG. 3, the frame 4 is supported by frame moving mechanisms 51 provided on the ink-jet printer 1 so as to be movable in the vertical direction. The frame moving mechanisms 51 are disposed outside of the arrangement of the plurality of, e.g., four, ink-jet heads 2 (upper side and lower side in FIG. 2). The frame moving mechanisms 51 each include a driving motor 52 as a drive source for moving the frame 4 upward and downward, a pinion gear 53 fixed to a shaft of the each driving motor 52, a rack gear 54 provided upright on the frame 4 so as to mesh the each pinion gear 53, and a guide 56 arranged at a position sandwiching the rack gear 54 with the pinion gear 53.

The plurality of, e.g., two, driving motors 52 are fixed to a body frame 1*d* of the ink-jet printer 1, and is arranged so as to oppose to each other in terms of the paper transporting direction B. The plurality of, e.g., two, rack gears 54 extend in the vertical direction, and lower end portions thereof are fixed to side surfaces of the frame 4 respectively. Side surfaces of the rack gear 54 opposite from the pinion gears 53 are in slidable contact with the guides 56. The guides 56 are fixed to the body frame 1*d*.

In this configuration, when the plurality of, e.g., two, driving motors 52 are synchronized and the respective pinion gears 53 are rotated in the normal and reverse directions, the rack gears 54 move in the vertical direction. The frame 4 and the plurality of, e.g., four, ink-jet heads 2 are moved in the vertical direction in association with the vertical movement of the rack gears 54.

Guide portions 59 are disposed on both sides of the ink-jet heads 2 in terms of the longitudinal direction. The each guide portion 59 includes a rod-shaped member 58 and a pair of guides 57 which sandwich the same therebetween. From among these members, the pair of guides 57 extend in the vertical direction as shown in FIG. 3, and are fixed to a body frames 1*e* opposing to each other in terms of the direction orthogonal to the paper transporting direction B respectively. In contrast, the rod-shaped members 58 extend in the vertical direction in the same manner as the guides 57 and are fixed to the side surfaces of the frame 4 in parallel to the body frames 1*e* so as to oppose to each other. In addition, the each rod-shaped member 58 is slidably sandwiched between the pair of guides 57. These guide portions 59 are capable of preventing the ejection surfaces 3*a* of the ink-jet heads 2 from inclining with respect to the peripheral surface 8*a* when the frame 4 is moved in the vertical direction by the frame moving mechanisms 51.

In general, the frame 4 is arranged to a "printing position" where the plurality of, e.g., four, ink-jet heads 2 discharge ink on the paper for printing (the position shown in FIG. 3). At the time of the maintenance of the ink-jet heads 2, the frame 4 is moved by the frame moving mechanisms 51 and the plurality of, e.g., four, ink-jet heads 2 are arranged at a level higher than the "printing position" (for example, a "head maintenance position" described later").

The respective ink-jet heads 2 are connected to ink tanks 49 in the ink tank unit 1*c* mounted in the space C. In other words, in the plurality of, e.g., four, ink tanks 49, the inks which are ejected by the ink-jet heads 2 corresponding thereto are stored. The inks are supplied from the respective ink tanks 49 to the ink-jet heads 2 via tubes (not shown) or the like.

The ink-jet printer 1 includes the maintenance unit 70 configured to perform the maintenance for the ink-jet heads 2 and arranged on the left side of the ink-jet heads 2 in FIG. 2 as shown in FIG. 2 and FIG. 3. The maintenance unit 70 includes plurality of, e.g., two, trays 71 and 75 which are movable in the horizontal direction. The tray 71 has a substantially rectangular box shape opening upward, and is capable of containing the tray 75 therein. The tray 71 and the tray 75 are detachably connected by engaging devices described later. The both are detachably attached according to a work to be performed in the maintenance process.

A holding member 74 in which a wiper 72 is held is fixed to the ink-jet heads 2 side of the tray 71. The holding member 74 has a U-shape in plan view, and the wiper 72 is held at a portion of the holding member 74 extended along the paper transporting direction B. In contrast, depressed portions 74*a* which configure the engaging devices are formed at end portions of the holding members 74 extending in the direction orthogonal to the paper transporting direction B.

The engaging devices are disposed in the vicinity of the respective sides of the trays 71 and 75 on the upper sides and the lower sides in FIG. 2, and each are mainly configured of the depressed portion 74*a* provided on the holding member 74 and a hooking member 83 supported by the tray 75. The hooking members 83 extend in the direction orthogonal to the paper transporting direction B, and each are rotatably supported at a center thereof. The hooking members 83 each are formed with a hooking portion 83*a* which engages the depressed portion 74*a* at an end portion on the side of the ink-jet heads 2. Abutment members 84 which are capable of coming into abutment with end portions 83*b* at positions of the respective hooking members 83 farthest from the ink-jet heads 2 are rotatably supported above the maintenance unit 70 respectively. When the abutment members 84 are rotated and comes into abutment with the end portions 83*b*, the engagement between the hooking portions 83*a* and the depressed portions 74*a* is released. In contrast, when the abutment members 84 are moved away from the end portion 83*b*, the hooking portions 83*a* engage the depressed portions 74*a* and a state shown in FIG. 3 is restored.

The tray 71 is released on a side surface opposite from the ink-jet heads 2 and, for example, when the engagement therebetween is released as during the wiping operation, only the tray 71 is movable except for the tray 75. Irrespective of the state of engagement of the engaging devices, when the maintenance unit 70 is moved horizontally as described later, the frame 4 is moved to the "head maintenance position" which is upward (in the direction indicated by an arrow C in FIG. 3) of the "printing position" in advance, and a space for the maintenance unit 70 is secured between the four ejection surfaces 3*a* and the peripheral surface 8*a*. Thereafter, the maintenance unit 70 is moved horizontally in the direction indicated by an arrow D in FIG. 3.

A waste ink receiving tray 77 is positioned immediately below the maintenance unit 70. The waste ink receiving tray 77 has a size which contains the tray 71 in plan view, and has a shape in which a side edge portion on the side of the tray 71 opposite from the ink-jet heads 2 is overlapped even when the tray 71 is moved to the right end in FIG. 2. An ink discharge hole 77*a* penetrated in the vertical direction is formed at an end portion of the waste ink receiving tray 77 on the side of the ink-jet heads 2. The ink discharge hole 77*a* allows the ink flowed into the waste ink receiving tray 77 to flow to a waste ink trap, not shown.

The wiper 72 and the tray 75 are positioned in the tray 71 in sequence from the side closer to the ink-jet heads 2. The wiper 72 is formed of a flat plate-shaped elastic material for wiping the ejection surfaces 3*a* in a wiping operation, and is disposed so as to extend in parallel to the paper transporting direction B. In the tray 75, the plurality of, e.g., four, head caps 90 having a rectangular shape in plan view are arranged corresponding to the ejection surfaces 3*a* of the respective ink-jet heads 2 as shown in FIG. 2. The respective head caps 90 are arranged such that the longitudinal directions thereof extend in parallel to the longitudinal direction of the ink-jet heads 2, and are arranged in the paper transporting direction B at the same pitches as the ink-jet heads 2.

Figure 5A:
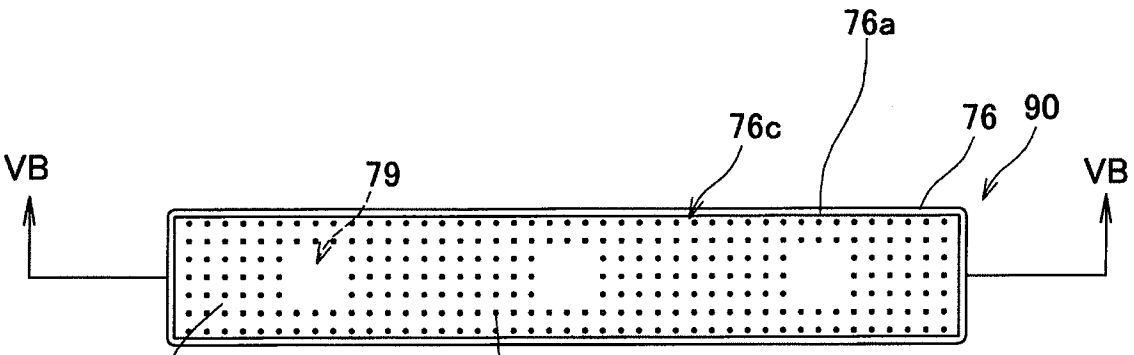
FIG. 5A is a plan view of a head cap shown in FIG. 2.
Figure 5B:
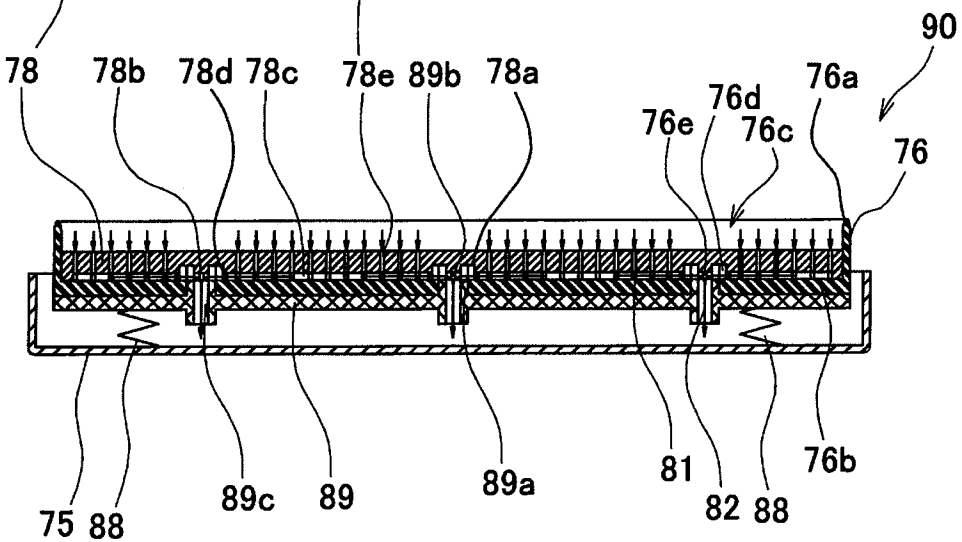
FIG. 5B is a cross-sectional view of the head cap shown in FIG. 2.
Figures 6A, 6B:
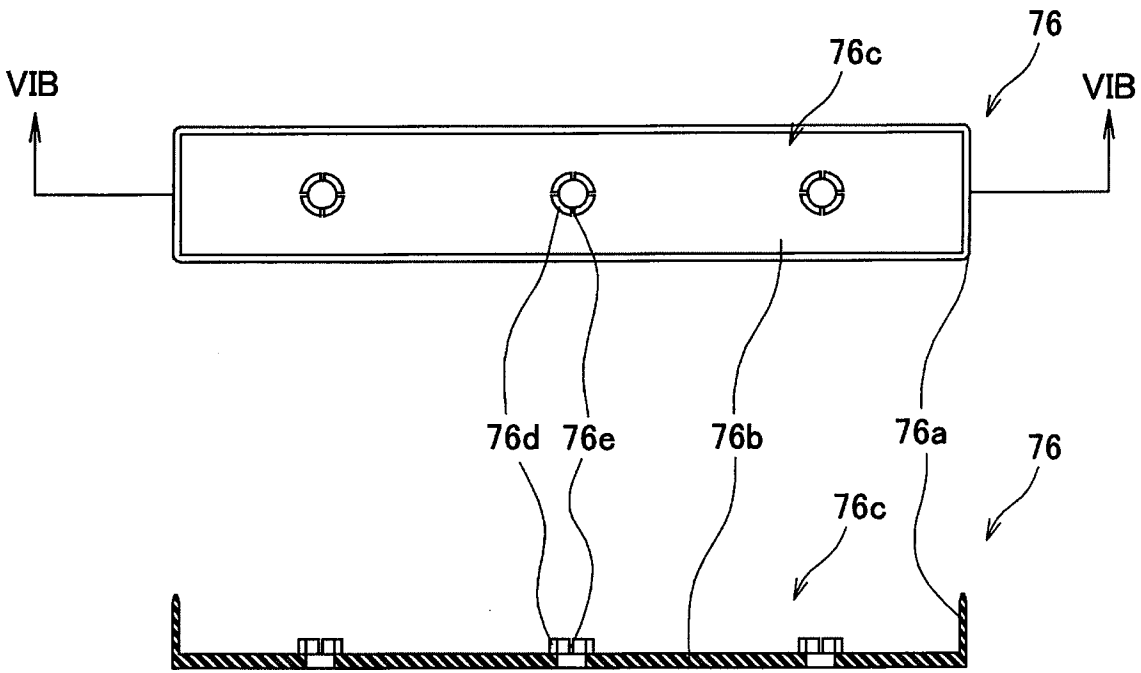
FIG. 6A is a plan view of the cap shown in FIG. 5A and FIG. 5B.
FIG. 6B is a cross-sectional view of the cap in FIG. 5A and FIG. 5B.
Figure 9:
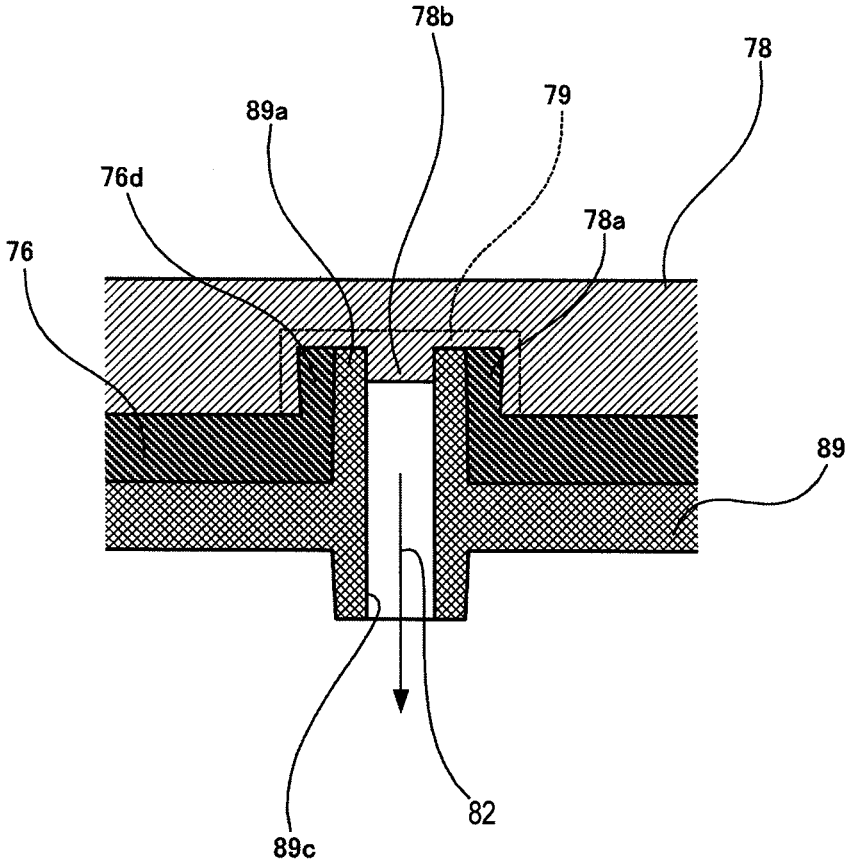
FIG. 9 is a partially enlarged cross-sectional view of the head cap shown in FIG. 5A and FIG. 5B.

Referring to FIGS. 5A and 5B, the head caps 90 each have a cap 76, a cap tip 78, and a holder 89. Referring to FIGS. 5A, 5B, FIGS. 6A, 6B, and FIG. 9, the cap 76 includes a substantially rectangular-shaped circular projection 76*a* projecting upward, and a bottom plate portion 76*b* being connected to a proximal end portion of the circular projection 76*a* and having a substantially elongated rectangular shape. The circular projection 76*a* and the bottom plate portion 76*b* are formed of elastic materials such as rubber or resin, and define a depressed portion 76*c* opening upward integrally with each other. In a capping operation described later, the depressed portion 76*c* seals nozzles 3*b* while surrounding an ejection area having the nozzles 3*b* opened through the ejection surface 3*a* by a distal end of the circular projection 76*a* coming into contact with the ejection surface 3*a*. On a bottom surface of the depressed portion 76*c* (an upper surface of the bottom plate portion 76*b*) is provided upright with a hollow outer cylindrical portion 76*d*. The outer cylindrical portion 76*d* is divided into a plurality of, e.g., four, parts by slits 76*e* extending in the axial direction. The slit 76*e* is formed from a distal end portion to a proximal end (the upper surface of the bottom plate portion 76*b*) of the outer cylindrical portion 76*d*. In FIG. 9, a cross-sectional view on which slits 78*b* and 89*b* do not appear is illustrated.

Referring to FIGS. 5A, 5B, FIGS. 7A, 7B, and FIG. 9, the cap tip 78 is a plate-shaped member arranged on the bottom surface of the depressed portion 76*c* of the cap 76. The thickness of the cap tip 78 is set to be ½ the projecting height of the circular projection 76*a* or smaller. Three fixing members 79 arranged along the longitudinal direction are configured integrally with the cap tip 78 on a lower surface of the cap tip 78 (the surface on the side of the bottom surface of the depressed portion 76*c*). At this time, the cap tip 78 covers the plurality of, e.g., three, fixing members 79. The fixing members 79 each include a fitting hole 78*a* opening downward, and a projecting portion 78*b* having a cylindrical shape projecting from centers of bottom surfaces of the respective fitting holes 78*a*. The plurality of, e.g., three, fixing members 79 are arranged on the bottom surface of the depressed portion 76*c*, and are arranged equidistantly in terms of the longitudinal direction of the cap tip 78. The fixing member 79 arranged at the center from among the three fixing members 79 is positioned at the center of the bottom surface of the depressed portion 76*c*. The height from an opening end portion of the fitting hole 78*a* to the bottom surface is the height of projection of the outer cylindrical portion 76*d* described above or higher.

Figures 7A, 7B:
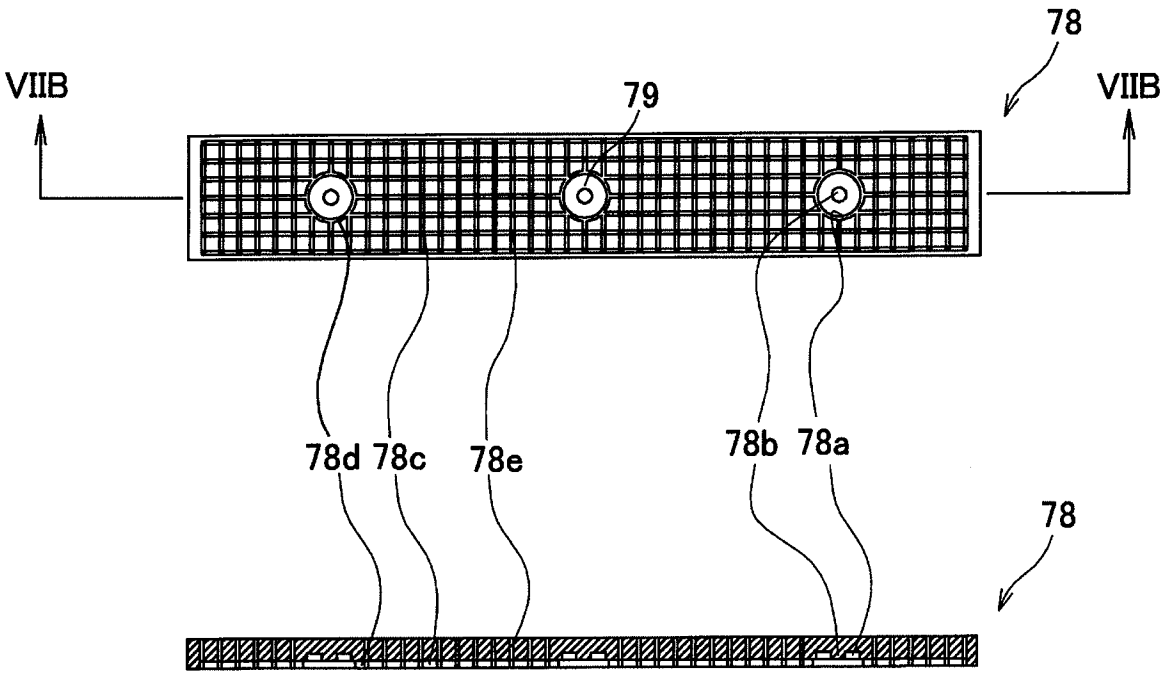
FIG. 7A is a plan view of a cap tip shown in FIG. 5B.
FIG. 7B is a cross-sectional view of the cap tip shown in FIG. 5B.
Figures 8A, 8B:
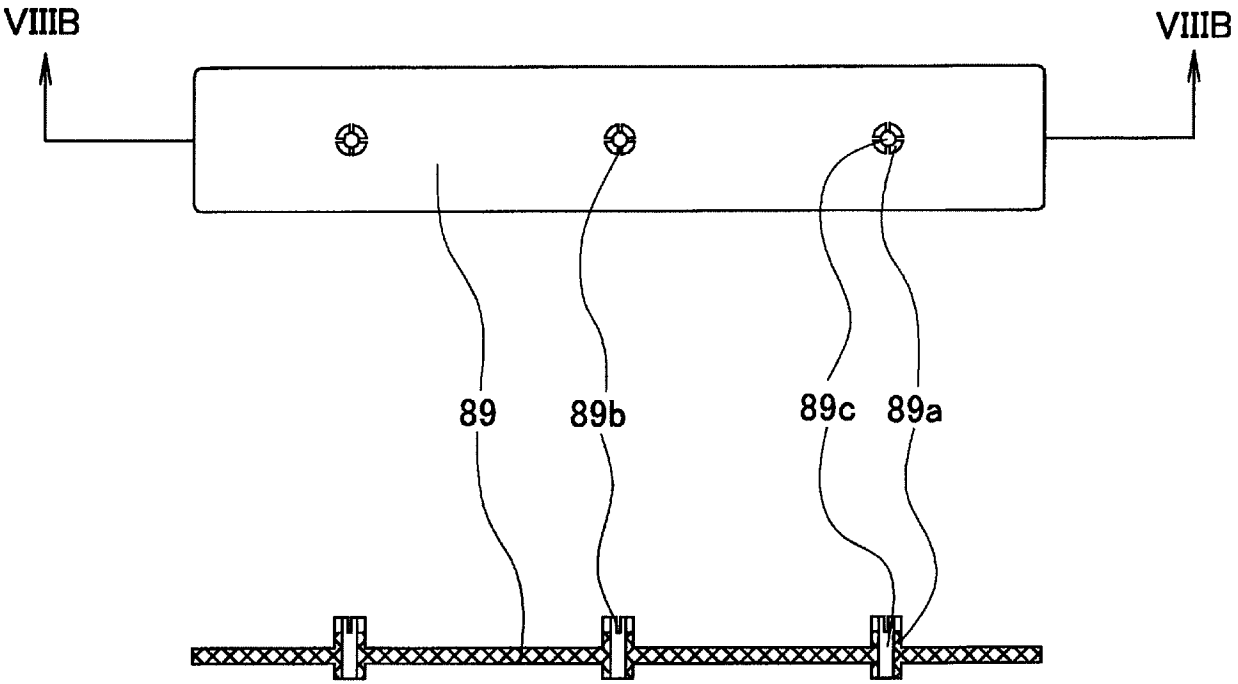
FIG. 8A is a plan view of a holder shown in FIG. 5B.
FIG. 8B is a cross-sectional view of the holder shown in FIG. 5B.

The lower surface of the cap tip 78 is configured with a grid like narrow groove 78*c* extending in the vertical and lateral directions in FIG. 7A, and circular grooves 78*d* connected to the narrow groove 78*c* while extending along peripheral edges of the respective fitting holes 78*a*. The narrow groove 78*c* and the circular grooves 78*d* define an introduction flow channel 81 in cooperation with the bottom surface of the depressed portion 76*c*. The cap tip 78 is configured with a plurality of communicating flow channels 78*e* penetrating through the cap tip 78 in the thickness direction, and an upper surface of the cap tip 78 and the respective intersections of the narrow groove 78*c* are in communication with each other. In this manner, the communicating flow channel 78*e* and the introduction flow channel 81 are in communication with each other.

Referring to FIGS. 5A, 5B, FIGS. 8A, 8B, and FIG. 9, the holder 89 is a plate-shaped member for holding the bottom plate portion 76*b* of the cap 76 from below. The holder 89 is formed with hollow inner cylindrical portions 89*a* provided upright so as to project from an upper surface (a surface on the side of the bottom plate portion 76*b*) and a lower surface. A portion near a distal end of the each inner cylindrical portion 89*a* projecting from an upper surface thereof is divided into a plurality of, e.g., four, parts by the slits 89*b* extending in the axial direction of the inner cylindrical portions 89*a*. The slits 89*b* extend from the distal end of the inner cylindrical portion 89*a* to a midsection of the inner cylindrical portion 89*a*, and leave from the midsection to a proximal end by a thickness of the bottom plate portion 76*b* of the cap 76 or smaller. Accordingly, the communication with the slit 76*e* of the outer cylindrical portion 76*d* is ensured.

The holder 89 is supported by the tray 75 via plurality of, e.g., two, springs 88, and is urged upward. Accordingly, when the circular projection 76*a* and the ejection surfaces 3*a* abut against each other, the springs 88 alleviate its impact force. Furthermore, even when an error is generated in parallelism of the circular projection 76*a* with respect to the ejection surfaces 3*a* to some extent, the circular projection 76*a* can follow the inclination with respect to the ejection surfaces 3*a*.

Referring to FIG. 9, the outer cylindrical portion 76*d* of the cap 76 is fitted to the fitting hole 78*a* by being inserted into the fitting hole 78*a* of the cap tip 78. The inner cylindrical portion 89*a* of the holder 89 is fitted to the outer cylindrical portion 76*d* by being inserted into the outer cylindrical portion 76*d* of the cap 76. At this time, the slit 76*e* of the outer cylindrical portion 76*d* and the slit 89*b* of the inner cylindrical portion 89*a* communicate with each other. The outer cylindrical portion 76*d* is clamped between an inner wall surface of the fitting hole 78*a* and an peripheral surface of the inner cylindrical portion 89*a* in terms of the radial direction (in the direction intersecting with the direction of projection of the circular projection 76*a*). Here, the inner diameter of the fitting hole 78*a* is narrowed as it goes toward an opening edge, and the outer cylindrical portion 76*d* and the inner cylindrical portion 89*a* are slightly tapered. Accordingly, the outer cylindrical portion 76*d* is tightly clamped between the inner wall surface of the fitting hole 78*a* and the peripheral surface of the inner cylindrical portion 89*a* in a water-tight manner. In addition, the projecting portion 78*b* of the cap tip 78 is fitted to the inner cylindrical portion 89*a* by being inserted into the inner cylindrical portion 89*a* of the holder 89.

In this manner, by the fixing members 79 fitted to the holder 89 via the bottom plate portion 76*b* of the cap 76, the cap 76 is fixed to the holder 89. Also, since the projecting portions 78*b* of the fixing members 79 are inserted into the inner cylindrical portions 89*a* of the holder 89, wall surfaces of the inner cylindrical portions 89*a* are prevented from falling inward by a pressure generated when the fitting holes 78*a*, the outer cylindrical portions 76*d*, and the inner cylindrical portions 89*a* are fitted.

The slits 76*e* of the outer cylindrical portions 76*d* and the slits 89*b* and internal spaces 89*c* of the inner cylindrical portions 89*a* define discharging flow channels 82. Also, the slits 76*e* of the outer cylindrical portions 76*d* communicate with the circular grooves 78*d* of the cap tip 78. In other words, the discharging flow channels 82 communicate with the depressed portions 76*c* via the communicating flow channels 78*e* and the introduction flow channels 81, and communicate with the outside via openings at lower ends of the inner cylindrical portions 89*a*. Ink ejected into the depressed portion 76*c* passes from the communicating flow channels 78*e* opening on an upper surface of the cap tip 78 through the introduction flow channels 81, and is guided into the discharging flow channels 82. The ink introduced into the discharging flow channels 82 is discharged to the outside from the openings at the lower ends of the inner cylindrical portions 89*a*. Ink tubes, not shown, are connected to the lower ends of the inner cylindrical portions 89*a* and the discharged ink is discharged to a waste ink trap, not shown, via the ink tubes.

Referring back to FIG. 2 and FIG. 3, the maintenance unit 70 is kept standstill at a "retracted position" (a left side position which is not opposed to the ink-jet heads 2 in FIG. 2) apart from the ink-jet heads 2 as shown in FIG. 3 when a maintenance described later is not performed. Then, when the maintenance is performed, the maintenance unit 70 is moved from the "retracted position" horizontally to a "maintenance position" opposed to the ejection surfaces 3*a* of the ink-jet heads 2. At this time, since the ink-jet heads 2 are arranged at the "head maintenance position", the wiper 72 or the distal ends of the circular projections 76*a* does not come into contact with the ejection surfaces 3*a*.

At the time of wiping operation, the tray 75 is left at the position and only the tray 71 is moved from the "retracted position" to a position below the head, and receives inks wiped by the wiper 72. When covering the ejection surfaces 3*a* with the caps 76 at the time of waiting and the purging operation, the tray 71 and the tray 75 are joined by the engaging devices, and are moved to the "maintenance position".

Referring to FIG. 2, the respective trays 71 and 75 are movably supported by a pair of guide shafts 96*a* and 96*b* extending in the direction orthogonal to the paper transporting direction B. The tray 71 is provided with a plurality of, e.g., two, bearing members 97*a* and 97*b*, which are projected from both upper and lower surfaces of the holding member 74. The tray 75 is provided with a plurality of, e.g., two, bearing members 98*a* and 98*b*, which are projected from both upper and lower surfaces of the tray 75. Also, the pair of guide shafts 96*a* and 96*b* are fixed at both ends thereof to the body frames 1*e* and 1*g* respectively, and are arranged in parallel to each other between the both frames 1*e* and 1*g*. Here, the guide shafts 96*a* and 96*b* are fixed with screws, respectively. In this configuration, the respective trays 71 and 75 are moved in the lateral direction in the drawing (the direction indicated by an arrow D) along the guide shafts 96*a* and 96*b*.

A horizontal movement mechanism 91 moves the trays 71 and 75 in the horizontal direction. The horizontal movement mechanism 91 includes a motor 92, a motor pulley 93, an idle pulley 94, a timing belt 95, and the guide shafts 96*a* and 96*b*, as shown in FIG. 2. The motor 92 is fixed to a mounting portion 1*f* formed at an end portion of the body frame 1*e* extending in parallel with the paper transporting direction B with a screw or the like. The motor pulley 93 is connected to the motor 92, and is rotated in association with the drive of the motor 92. The idle pulley 94 is rotatably supported by the body frame 1*g* located at the leftmost position in FIG. 2. The timing belt 95 is disposed in parallel with the guide shaft 96*a* and is wound around a pair of the motor pulley 93 and the idle pulley 94 so as to run therebetween. The bearing portion 97*a* provided on the holding member 74 is connected to the timing belt 95.

In this configuration, when the motor 92 is driven, the timing belt 95 runs in association with the normal or reverse rotation of the motor pulley 93. With the traveling of the timing belt 95, the tray 71 connected to the timing belt 95 via the bearing member 97*a* is moved in the direction toward the "retracted position" or the "maintenance position" leftward or rightward in FIG. 2. When the depressed portions 74*a* of the holding member 74 and the hooking portions 83*a* are engaged, the wiper 72 in the tray 71 and the caps 76 in the tray 75 move together, and when the hooking portions 83*a* are apart from the depressed portions 74*a*, only the wiper 72 in the tray 71 is moved.

Figure 10:
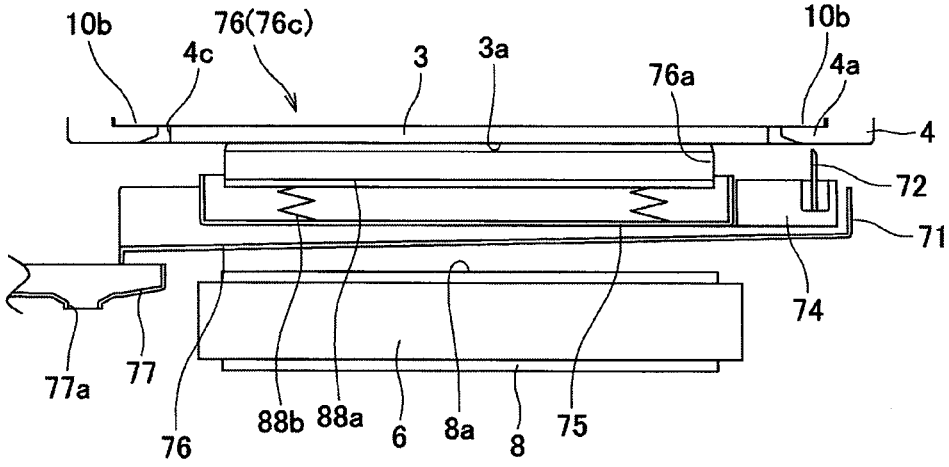
FIG. 10 shows a state in which a circular projection of the cap shown in FIG. 5A and FIG. 5B and an ejection surface are in contact with each other.

Referring to FIG. 10 and FIG. 11, the operation of the maintenance unit 70 will be described. When performing the purging operation for restoring the ink-jet head 2 which is suffering from ejection failure or the like, the capping operation for sealing the ejection surfaces 3*a* with the caps 76 is performed. The frame 4 is moved upward by the frame moving mechanisms 51 to arrange the ink-jet heads 2 to a "head maintenance position". Accordingly, a space in which the maintenance unit 70 can be arranged is formed between the ejection surfaces 3*a* and the transporting belt 8.

Referring to FIG. 10, the tray 71 and the tray 75 are moved from the "retracted position" to the "maintenance position" in a state in which the tray 71 and the tray 75 are connected by the hooking member 83 by the horizontal movement mechanism 91. At this time, the depressed portions 76*c* of the caps 76 are arranged at a position opposing the periphery of the ink ejection areas where the nozzles 3*b* are opened. In addition, the ink-jet heads 2 are moved to a "capping position" located below by the frame moving mechanisms 51 to bring the circular projections 76*a* into contact with the ejection surfaces 3*a*. In this manner, the ink ejection areas of the ejection surfaces 3*a* are covered by the depressed portions 76*c* of the caps 76, such that the nozzles 3*b* are sealed. In this procedure, the capping operation is completed. Accordingly, the nozzles 3*b* are prevented from being dried even though the waiting state continues.

When performing the purging operation, in this state, a pump configured to forcedly deliver the ink in the ink tank 49 (not shown) to the ink-jet heads 2 is driven to perform the purging operation for discharging ink from the nozzles 3*b* of the ink-jet head 2 to the interiors of the caps 76. With this purging operation, clogging of the nozzles 3*b* which are suffering from the ejection failure or increase in viscosity of ink in the nozzles 3*b* is solved.

At this time, the inks ejected into the caps 76 pass from the communicating flow channels 78*e* opening on upper surfaces of the cap tips 78 through the introduction flow channels 81, and are guided into the discharging flow channels 82. The inks introduced into the discharging flow channels 82 are discharged to the outside from the openings at the lower ends of the inner cylindrical portions 89*a*. Ink tubes, not shown, are connected to the lower ends of the inner cylindrical portions 89*a* and the discharged inks are discharged to a waste ink trap, not shown, via the ink tube. However, part of the ink remains on the ejection surfaces 3*a* as ink drops.

Figure 11A:
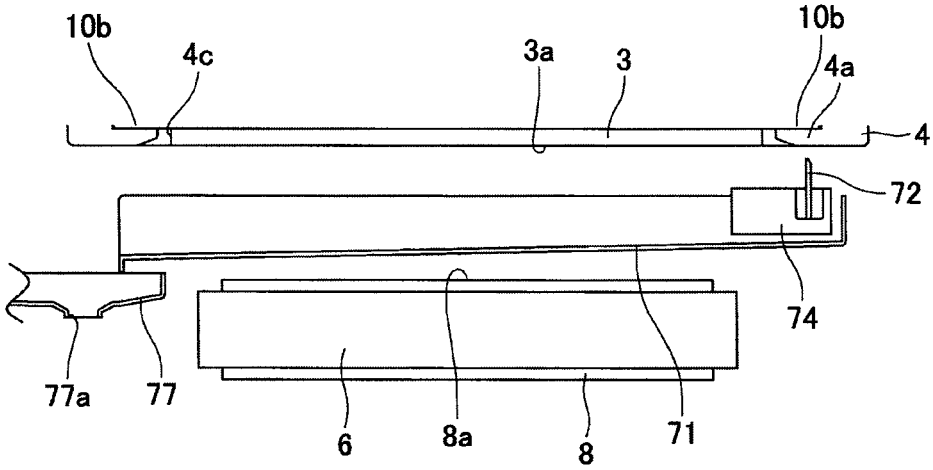
FIG. 11A shows a state where the ink-jet head shown in FIG. 2 is moved from a "printing position" to a "head maintenance position" and a tray of a maintenance unit is moved to a "maintenance position".

In order to perform the wiping operation, the frame 4 is moved upward by the frame moving mechanisms 51 again to arrange the ink-jet heads 2 to the "head maintenance position". Subsequently, the tray 71 and the tray 75 are moved from the "maintenance position" to the "retracted position" by the horizontal movement mechanism 91. Then, the abutment members 84 are brought into abutment with the end portions 83*b* of the hooking members 83 to move the hooking portions 83*a* apart from the depressed portions 74*a*, such that the engagement between the depressed portions 74*a* and the hooking portions 83*a* are released. In other words, the connection between the tray 71 and the tray 75 is released. In this state, the tray 71 is moved from the "retracted position" to the "maintenance position" by the horizontal movement mechanism 91 as shown in FIG. 11A.

Figure 11B:
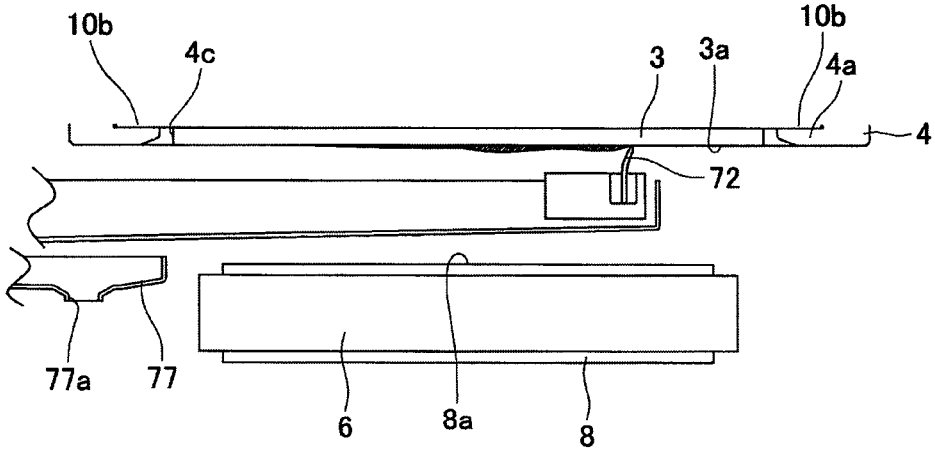
FIG. 11B shows a state in which ink attached to the ejection surface is wiped off by a wiper shown in FIG. 2.

The ink-jet heads 2 are moved downward by the frame moving mechanisms 51. At this time, when the tray 71 is moved leftward in FIG. 11 (that is, the direction from the "maintenance position" to the "retracted position"), the ink-jet heads 2 are arranged at the "wiping position" where a distal end of the wiper 72 comes into contact with the ejection surfaces 3*a*. Then, as shown in FIG. 11B, the tray 71 is moved from the "maintenance position" to the "retracted position" by the horizontal movement mechanism 91.

In this wiping operation, since an upper end of the wiper 72 is located above the level of the ejection surfaces 3*a*, it comes into contact with the ejection surfaces 3*a* while being deflected, such that the ink adhered to the ejection surfaces 3*a* is wiped by the purging operation. The ink wiped by the wiper 72 runs over a surface of the wiper 72 and flows into the waste ink receiving tray 77. Then, the ink is discharged from the discharge hole 77*a* of the waste ink receiving tray 77.

In this manner, the maintenance operation in which the ink-jet heads 2 being suffering from the ink ejection failure are restored by the capping operation and the purging operation, and the inks adhered to the ejection surfaces 3*a* are wiped by the wiping operation is ended.

Subsequently, in the waiting state, or when the ink-jet printer 1 is brought into an OFF state, the ink-jet heads 2 are arranged at the "head maintenance position", the tray 71 is moved again to the "maintenance position" in association with the tray 75, and the ink-jet heads 2 are moved downward to the "capping position". Alternatively, when restarting the image formation, the ink-jet heads 2 are moved downward to the "printing position" with the plurality of, e.g., two, trays 71 and 75 left at the "retracted position".

According to the ink-jet printer 1 in the embodiment as described above, the caps 76 are fixed to the holder 89 by the fixing members 79 arranged on the bottom surface of the depressed portion 76*c* of the cap 76 fitted to the holder 89 via the bottom plate portion 76*b* of the caps 76. Here, the thickness of the fixing members 79 is a fraction of the height of the circular projection 76*a* or smaller. Therefore, the fitting portion between the cap 76 and the holder 89 do not project outward by the circular projection 76*a*, such that downsizing of the head cap 90 is achieved.

Since the fixing members 79 are arranged at the center of the bottom surface of the depressed portion 76*c*, the cap 76 can be fixed to the holder 89 in a balanced state.

Since the plurality of, e.g., three, fixing members 79 are arranged equidistantly in terms of the longitudinal direction of the cap tip 78, the cap 76 is fixed to the holder 89 at three positions, such that the elongated cap 76 is reliably fixed to the holder 89. Also, warp of the cap 76 in terms of the longitudinal direction is restrained.

Since the cap tip 78 is accurately fixed to the bottom surface of the depressed portion 76*c* by the fixing members 79, contact of the narrow groove 78*c* and the circular grooves 78*d* with respect to the bottom surface of the depressed portion 76*c* is ensured. Accordingly, the introduction flow channel is reliably formed, and the liquid discharged to the depressed portion 76*c* of the cap 76 can be discharged reliably to the outside via the introduction flow channel 81 and the discharging flow channel 82 communicating thereto.

The cap tip 78 and the holder 89 can be fitted via the bottom plate portion 76*b* in a simple structure in which the inner cylindrical portions 89*a* are inserted to the outer cylindrical portions 76*d* while inserting the outer cylindrical portions 76*d* into the fitting holes 78*a* such that the outer cylindrical portions 76*d* are clamped between the inner wall surfaces of the fitting holes 78*a* and the peripheral surfaces of the inner cylindrical portions 89*a* in the radial direction thereof.

Since the projecting portions 78*b* of the cap chip 78 are inserted into the inner cylindrical portions 89*a* of the holder 89, the wall surfaces of the inner cylindrical portions 89*a* are prevented from falling inward by the pressure generated when the fitting holes 78*a*, the outer cylindrical portions 76*d*, and the inner cylindrical portions 89*a* are fitted. Accordingly, the outer cylindrical portions 76*d* are clamped between the inner wall surfaces of the fitting holes 78*a* and the peripheral surfaces of the inner cylindrical portion 89*a* at a predetermined pressure in terms of the radial direction, such that the cap 76 can be fixed to the holder 89 tightly.

At this time, a portion near a distal end of the each inner cylindrical portion 89*a* projecting from the upper surface is divided into a plurality of, e.g., four, parts by the slits 89*b* extending in the axial direction of the inner cylindrical portion 89*a*. Accordingly, the distal end of the inner cylindrical portion 89*a* is opened in the radial direction when the inner cylindrical portion 89*a* is fitted to the projecting portion 78*b*, such that the outer cylindrical portion 76*d* is tightly clamped between the fitting hole 78*a* and the inner cylindrical portion 89*a*.

At this time, since the outer cylindrical portion 76*d* is divided into a plurality of, e.g., four, parts by the slits 76*e* and the slits 76*e* and the slits 89*b* of the inner cylindrical portion 89*a* are communicated with each other, the outer cylindrical portion 76*d* can be easily deformed in terms of the radial direction, and the outer cylindrical portion 76*d* and the inner cylindrical portion 89*a* can be opposed to each other efficiently. Therefore, the outer cylindrical portion 76*d* can be clamped efficiently between the fitting hole 78*a* and the inner cylindrical portion 89*a*.

In addition, at this time, since the discharging flow channel 82 includes the slits 76*e* of the outer cylindrical portion 76*d* and the slits 89*b* of the inner cylindrical portion 89*a*, and the slits 76*e* communicate with the introduction flow channels 81, the ink introduced by the introduction flow channels 81 passes from the slits 76*e* through the discharging flow channels 82 and is discharged efficiently to the outside.

The cap tip 78 covers the fixing members 79 integrally. Accordingly, the ink in the depressed portion 76*c* is prevented from leaking out to the outside from the fitted positions (between the fitting holes 78*a* and the outer cylindrical portions 76*d*, and between the outer cylindrical portions 76*d* and the inner cylindrical portions 89*a*).

Although the description of the embodiments has been described above, the invention is not limited to the embodiments, and various modifications are possible. For example, the three fixing members 79 of the cap tip 78 are arranged at the center of the bottom surface of the depressed portion 76*c* in the embodiment described above, the number and the position of the fixing members 79 may be arbitrary. For example, the fixing member 79 may be arranged solely at the center of the bottom surface of the depressed portion 76*c*, or the two fixing members 79 may be arranged near the both ends of the bottom surface of the depressed portion 76*c*.

Although the fixing members 79 are integrally formed with the cap tip 78 in the embodiment described above, the fixing members 79 may be formed as independent members. For example, the respective fixing members 79 may be formed independently, or a plurality of the fixing members 79 may be formed integrally. In this case, a configuration in which the head cap does not have the cap tip is also applicable.

In this case, although the head cap 90 has a configuration in which the ink ejected into the depressed portion 76*c* of the cap 76 is discharged to the outside via the communicating flow channels 78*e*, the introduction flow channels 81 and the discharging flow channels 82, a configuration in which the head cap does not have the communicating flow channel 78*e*, the introduction flow channel 81, and the discharging flow channel 82, and the ink in the depressed portion 76*c* is not discharged to the outside is also applicable if the ink is not ejected into the depressed portion 76*c* in the purging operation.

Although the portions projecting from the upper surfaces of the inner cylindrical portions 89*a* of the holders 89 each are divided into four parts near the distal ends thereof by the slits 89*b* in the embodiment described above, the portions near the distal ends of the inner cylindrical portions 89*a* may each be divided into two parts or five parts or more.

Although the outer cylindrical portions 76*d* of the cap 76 are each divided into four parts by the slits 89*b* in the embodiment described above, the outer cylindrical portions 76*d* may be divided into two parts or five parts or more.

Although the fitting holes 78*a* are fitted to the holders 89 via the bottom plate portion 76*b* by inserting the inner cylindrical portions 89*a* into the outer cylindrical portions 76*d* while inserting the outer cylindrical portions 76*d* into the fitting holes 78*a* in the embodiment described above, the fixing members may be fitted to the holders via the bottom plate portion in other configuration as long as at least the bottom plate portion is clamped in the direction intersecting the projecting direction of the circular projections 76*a*. For example, column-shaped projecting portions may be provided upright on the upper surface of the holders instead of the inner cylindrical portions 89*a* of the holder.

Although the example in which the invention is applied to the ink-jet printer 1 has been described in the embodiment described above, the invention is also applicable to the apparatus having a liquid droplet head for discharging other types of liquid. Although the ink-jet printer 1 has the plurality of, e.g., four, head caps 90 in the embodiment described above, a configuration in which only the head cap 90 is independent is also applicable.

What is claimed is:

1. A head cap comprising:

a cap body comprising a circular projection which is configured to surround a liquid droplet ejection area formed on an ejection surface of a liquid droplet ejection head by contacting with the ejection surface, and a bottom plate portion which is configured to define a depressed portion in cooperation with the circular projection and to which the circular projection is connected;

a holder which is configured to hold the bottom plate portion; and a fixing member which is configured to fix the cap body to the holder by being fitted to the holder via the bottom plate portion and disposed on a bottom surface of the depressed portion, wherein the fixing member and the holder clamp the bottom plate portion in the direction intersecting the direction of projection of the circular projection.

2. The head cap according to claim 1, wherein the fixing member is positioned at a center of the bottom surface of the depressed portion.

3. The head cap according to claim 1, wherein a plurality of fixing members are arranged on the bottom surface of the depressed portion.

4. The head cap according to claim 3, wherein the plurality of fixing members are arranged along a longitudinal direction of the bottom surface of the depressed portion.

5. The head cap according to claim 1, wherein the bottom plate portion and the holder comprise a discharging flow channel which is configured to communicate the depressed portion and the outside.

6. The head cap according to claim 5, further comprising a liquid introducing member which is a plate-shaped member disposed on the bottom surface of the depressed portion integrally with the fixing member, and comprises a groove which defines an introduction flow channel communicating with the discharging flow channel in cooperation with the bottom surface of the depressed portion and a communicating flow channel which is configured to bring the introduction flow channel and an upper surface of the plate-shaped member into communication with each other.

7. The head cap according to claim 6, wherein the fixing member comprises a fitting hole formed on the surface on the side of the bottom surface of the depressed portion.

8. The head cap according to claim 7, wherein the bottom plate portion comprises a hollow outer cylindrical portion which projects upright from the bottom surface of the depressed portion and is fitted to the fitting hole by being inserted into the fitting hole.

9. The head cap according to claim 8, wherein the holder further comprises a hollow inner cylindrical portion which projects upright from a surface on the side of the bottom plate portion and is fitted to the outer cylindrical portion by being inserted into the outer cylindrical portion.

10. The head cap according to claim 9, wherein the outer cylindrical portion is clamped between an inner wall surface of the fitting hole and an outer peripheral surface of the inner cylindrical portion in the radial direction, and wherein the discharging flow channel comprises an internal space of the inner cylindrical portion.

11. The head cap according to claim 10, wherein the fixing member further comprises a projecting portion projecting from a center of the fitting hole, and the projecting portion is configured to fit to the inner cylindrical portion by being inserted into the inner cylindrical portion of the holder.

12. The head cap according to claim 11, wherein a portion of the inner cylindrical portion at a distal end thereof is divided into a plurality of parts by a slit extending in an axial direction of the inner cylindrical portion.

13. The head cap according to claim 12, wherein the outer cylindrical portion is divided into a plurality of parts by the slit extending in the axial direction, and the slit of the outer cylindrical portion is in communication with the slit of the inner cylindrical portion respectively.

14. The head cap according to claim 13, wherein the discharging flow channel further comprises the slit of the outer cylindrical portion and the slit of the inner cylindrical portion, and the slit of the outer cylindrical portion communicates with the introduction flow channel.

15. The head cap according to claim 6, wherein the liquid introducing member is configured to cover the fixing member.

16. An ink-jet printer comprising:

the head cap according to claim 1; and a liquid droplet ejection head which is configured to eject a liquid droplet.

* * * * *